US006744901B2

(12) United States Patent
Ito et al.

(10) Patent No.: US 6,744,901 B2
(45) Date of Patent: Jun. 1, 2004

(54) HEADPHONE

(75) Inventors: Tomohiro Ito, Tokyo (JP); Naotaka Tsunoda, Tokyo (JP); Tomomi Hamada, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/203,080

(22) PCT Filed: Dec. 4, 2001

(86) PCT No.: PCT/JP01/10593

§ 371 (c)(1),
(2), (4) Date: Oct. 9, 2002

(87) PCT Pub. No.: WO02/51200

PCT Pub. Date: Jun. 27, 2002

(65) Prior Publication Data

US 2003/0091209 A1 May 15, 2003

(30) Foreign Application Priority Data

Dec. 7, 2000 (JP) ..... 2000-373073

(51) Int. Cl.[7] ..... H04R 25/00

(52) U.S. Cl. ..... 381/374; 381/379; 381/383

(58) Field of Search ..... 381/370, 374, 381/377, 378, 379, 381, 383, 330; 379/430; 181/129, 130, 135

(56) References Cited

U.S. PATENT DOCUMENTS 6,233,345 B1 * 5/2001 Urwyler ..... 381/381
6,385,325 B1 * 5/2002 Nageno et al. ..... 381/374

* cited by examiner

*Primary Examiner*—Huyen Le
(74) *Attorney, Agent, or Firm*—Jay H. Maioli

(57) ABSTRACT

In a neckband type headphone device there is provided a band onto which speaker units are connected at both ends thereof. These speaker units are worn on the left and right ears. The band has a shape wherein the area close to the connecting part between both speaker units forms a curve and passes on one of a position above and below the ears of the listener when it is wound in a circular shape and extended. The band is formed from an elastic material into a shape that presses down at the approximate center on the rear of the head of the listener.

5 Claims, 13 Drawing Sheets

(PRIOR ART)

(PRIOR ART)

30
30a
20
10
40
41
40L
40R
R
G
L

HEADPHONE

TECHNICAL FIELD

The present invention relates to a headphone device for listening to audio or sound by connecting to the source of audio signals. In particular, the present invention relates to a headphone device that can be made smaller in size when not worn.

BACKGROUND ART

Conventionally, a device that is positioned on a band and hangs on the rear of the head from both ears of the listener has been practically used as a headphone device. This type of headphone device is referred to as a neckband type because the band is positioned on the rear of the head slightly above the neck at the rear of the head.

FIG. 1 is a perspective view that shows an example of a neckband type headphone device that is currently in the market. For this headphone device a left-side speaker unit 1 and a right-side speaker unit 2, which incorporate therein driver units with diameters of a few centimeters, are connected by an almost semicircular band 3.

An earpad is attached to the inside of each of speaker units 1, 2 delivering sound from the speaker units to the ears of the wearer (listener) through the speakers. The band 3 is formed by a hard material such as synthetic resin or metal. In this example, one side of a signal line, that connects to an audio signal source such as a disk player, tape player or radio receiver, is connected to the left-side speaker unit.

Hooks 5, 6 are attached to the connecting parts of respective speaker units 1, 2 and the band 3. These hooks are inserted from above at the rear of both left and right ears of the listener and are worn in a manner such that the left ear of the listener is pinched by the speaker unit 1 and the hook 5, and the right ear of the listener is pinched by the speaker unit 2 and the hook 6. FIGS. 3A, 3B and 3C show three views of an example of this neckband type headphone device being worn. As shown in FIG. 3B (side view) and FIG. 3C (top view), the band 3 is positioned almost horizontal on the rear of the head of the listener.

Because the band is positioned at the rear of the head, compared to a conventional headphone device in which the band is positioned at the top of the head, a neckband type headphone device worn in this manner can be worn without affecting the hairstyle of the listener as well as having a appealing look when worn. Consequently, it is receiving wide acceptance from fashion-conscious people.

The neckband type headphone device shown in FIG. 1 has a shape that can be folded over and reduced in size when stored. In other words, the composition in this example is such that hinge parts 3*a*, 3*b*, 3*c* which can swing are provided at three locations, almost at the center of the band 3, the left side and the right side. For example, the hinge part 3*a* at the center can be folded towards the inside (direction indicated by arrow a in FIG. 1) and the left/right hinge parts 3*b*, 3*c* can be folded downward (direction indicated by arrows b, c in FIG. 1). As shown in FIG. 2 as an example, by means of folding the band 3 in this manner, the left/right speaker units 1, 2 can be folded over and reduced in size in a closed state. Making it possible to fold over and reduce the size is convenient when storing and transporting the headphone device.

By the way, the band 3 of the conventional neckband type headphone device as shown in FIG. 1 is shaped on the assumption that people who wear the device have large heads in order to allow anyone to use the device. Because of this, as shown in FIG. 3B and FIG. 3C, a gap s will occur between the rear of the head and the band for almost all people when wearing the device. If this type of gap occurs, there is a chance that the band may be pressed forward and the headphone units shift and fall from the ears when, for example, the wearer leans on a chair or wall and is not preferred. It is not impossible to provide an adjustment mechanism to make it possible to adjust the size of the band although a band mechanism is complicated and the design of the headphone device will worsen. In addition, providing an adjustment mechanism increases the weight of the headphone device and is not preferred.

Furthermore, by means of providing hinge parts 3*a*, 3*b*, 3*c* at a plurality of locations as described above, the headphone device folds over reducing in size thereby improving its portability. However, when these type of hinge parts are provided, the composition of the band becomes complicated by that alone resulting in increased manufacturing costs of the headphone device. In particular, in the example of FIG. 1, the signal line 4 that is connected to the audio signal source only comes out from one of the speaker units 1 and is called a single line type. For this case however, a signal line is necessary that passes through the inside of the band 3 connecting the speaker unit 2 on the opposite side and the signal line 4. Consequently, a shape that allows the headphone device to be folded while passing the signal line through each of the hinge parts 3*a*, 3*b*, 3*c* is necessary making this a very complicated mechanism.

DISCLOSURE OF THE INVENTIONS

The object of the present invention is to provide a neckband type headphone device with a simple composition that is easy to carry and wear.

A first invention is a headphone device comprised of a left-side speaker unit worn on the left ear of a listener, a right-side speaker unit worn on the right ear of a listener, and a band. The left-side speaker unit is connected to one end of the band and the right-side speaker unit is connected to the other end of the band. The band has a shape wherein the areas close to the connecting parts with both speaker units form a curve and pass above or below the ears of the listener when it is wound in a circular shape and extended. The band is formed of an elastic material into a shape that presses down at the approximate center on the rear of the head of the listener.

By means of providing a headphone device in this manner, when stored, the elasticity of the band itself will wind the band into a circular shape thereby reducing the size giving it a convenient shape for storage and transport. In addition, because the area close to the ends of the extended band forms a curve and passes above or below the ears of the listener, the speaker units are held on the ears with the approximate center of the band pressing down on the rear of the head of the listener. Consequently, the band itself is worn on the head of the listener with almost no space eliminating the need for a separate adjustment mechanism, thereby providing a comfortable wearing experience for everyone. For this case, because the elasticity of the band itself determines the shape when stored and when worn, the composition is very simple. Namely, this makes it possible to achieve a simple construction with favorable portability and wearability as a neckband type headphone device.

A second invention is a device in the headphone device of the first invention wherein an audio signal line that connects one of the speaker units to the other speaker unit is passed through the band and connects to an audio signal source from only one of the speaker units.

By means of providing a headphone device in this manner, the signal line of the headphone device is drawn through only one of the speaker unit eliminating any hindrance when wearing the headphone device.

A third invention is a device in the headphone device of the first invention wherein the left-side speaker unit and the right-side speaker unit are positioned in close proximity to each other due to the elasticity of the band when the headphone device is not being worn.

By means of providing a headphone device in this manner, the shape of the device becomes very small when not worn.

A fourth invention is a device in the headphone device of the first invention wherein when the left-side speaker unit and the right-side speaker unit are positioned in close proximity to each other due to the elasticity of the band at a time of the headphone device being not worn, the audio output surfaces of the two speaker units line up almost flat.

By means of providing a headphone device in this manner, it becomes possible to achieve a flat shape with no protrusions when the headphone device is not being worn as well as make it easy to store and carry the device.

A fifth invention is a device in the headphone device of the first invention wherein the band itself close to the connecting parts with both speaker units forms a curved shape that rests above the ears of the listener when the band is extended.

By means of providing a headphone device in this manner, the speaker units can be held on the ears by just the band, thereby making a simple composition possible that does not require another member to hold the speaker units on the ears.

A sixth invention is a device in the headphone device of the first invention wherein another member is attached that rests on the ears of the listener close to the connecting parts between both speaker units and the band.

By means of providing a headphone device in this manner, there can be provided a composition whereby the headphone device can be worn with the band in a shape that does not pass it above the ears of the listener.

BRIEF DESCRIPTION OF THE DRAWINGS

FIG. 3 shows three views of an example when the headphone device of FIG. 1 is worn, wherein

FIG. 6 is a circuit diagram that shows connection circuit examples of the headphone device according to the first embodiment of the present invention, wherein

FIG. 9 shows three views of an example when the headphone device according to the first embodiment of the present invention is worn, wherein

BEST EMBODIMENTS FOR CARRYING OUT THE INVENTION

In the following, a first embodiment of the present invention will be described with reference to FIG. 4 to FIG. 11.

Figure 1:
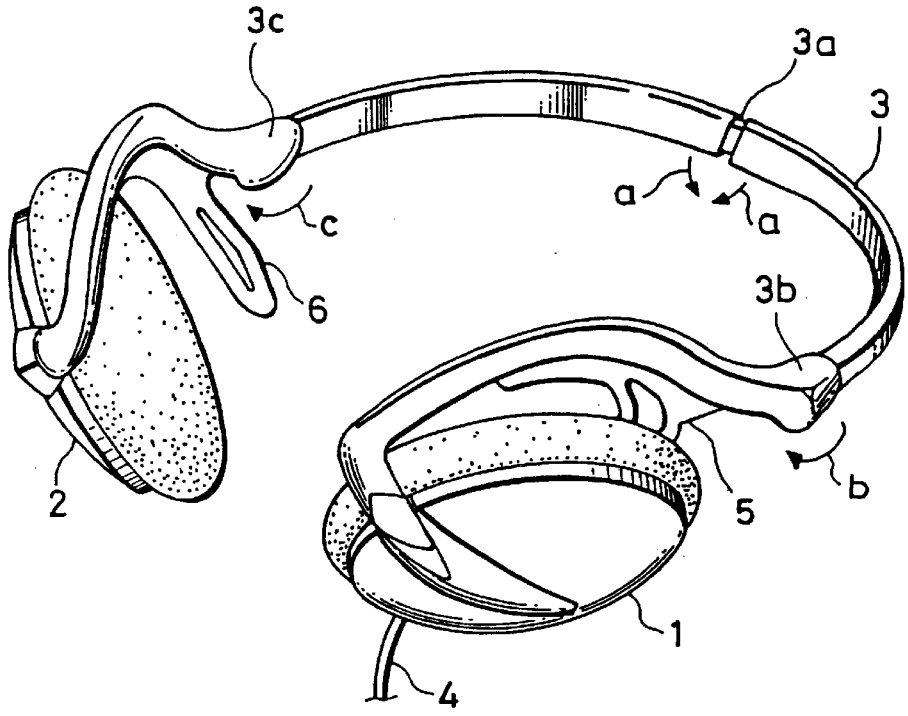
FIG. 1 is a perspective view that shows an example of a conventional neckband type headphone device.
Figure 2:
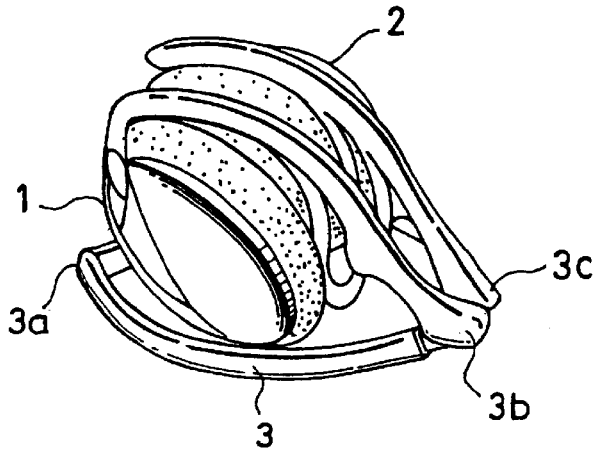
FIG. 2 (PRIOR ART)
FIG. 2 is a perspective view that shows an example in which the headphone device in FIG. 1 is folded up.
Figure 3A:
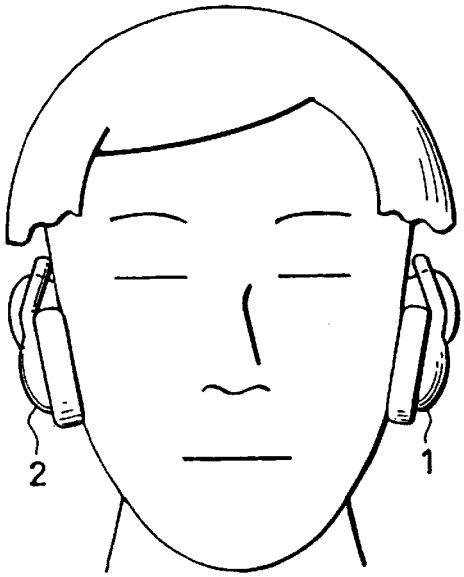
FIG. 3A is a front view.
Figure 3B:
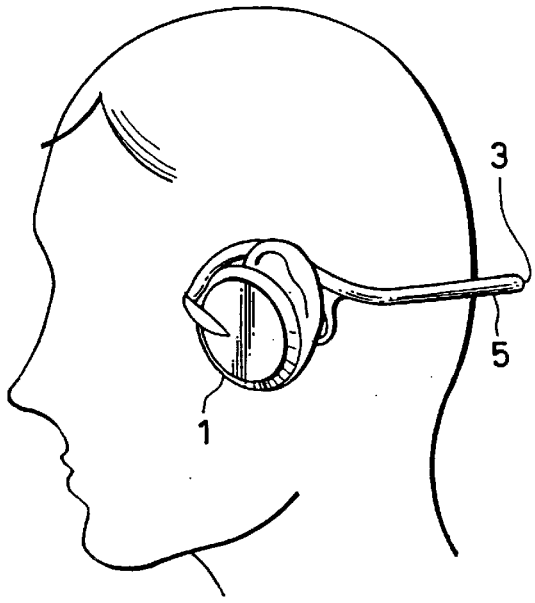
(PRIOR ART) FIG. 3B
FIG. 3B is a side view and FIG. 3C is a top view.
Figure 3C:
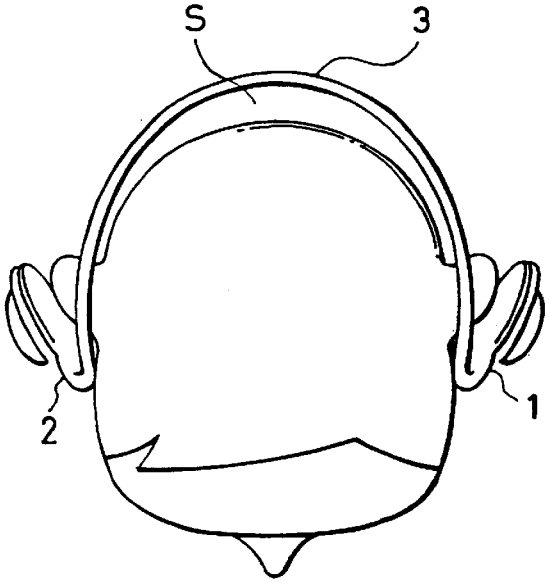
(PRIOR ART) FIG. 3C
Figure 4:
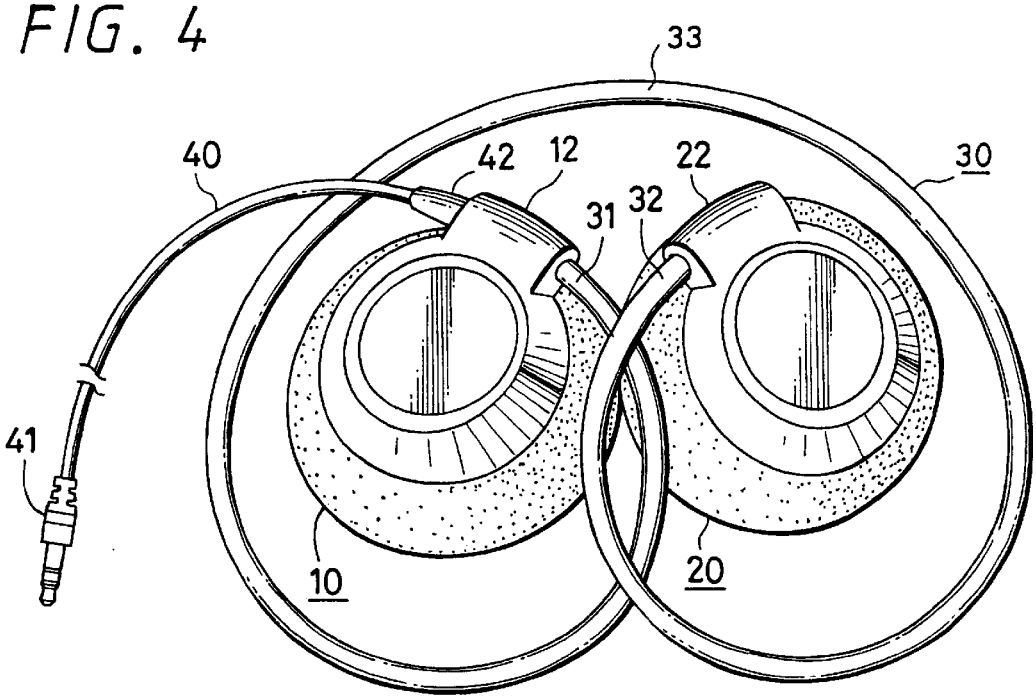
FIG. 4 is a top plan view that shows an example of the headphone device seen from the surface according to a first embodiment of the present invention.
Figure 5:
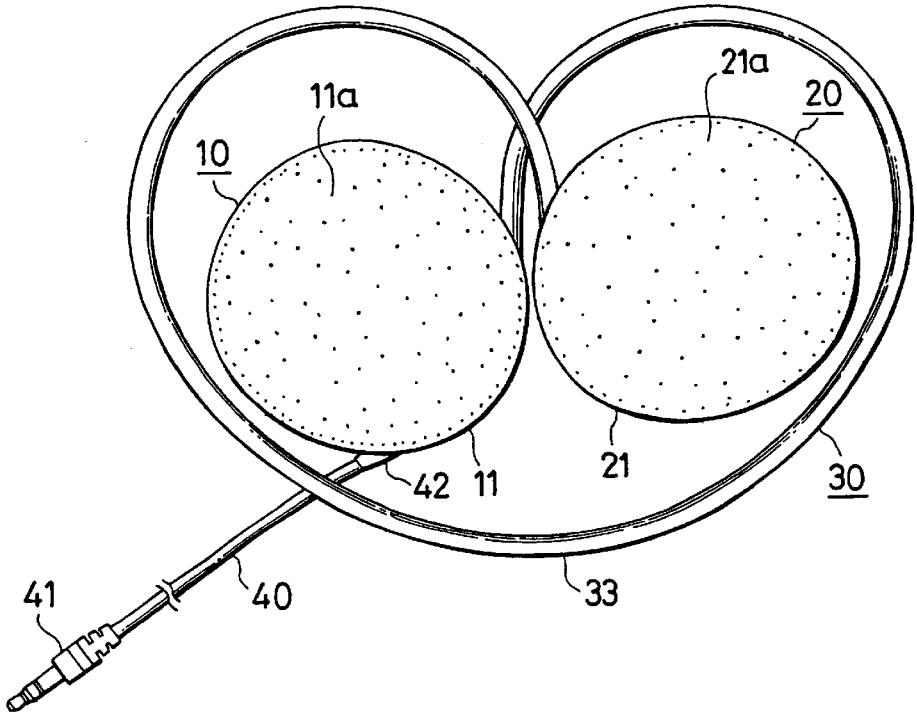
FIG. 5 is a top plan view that shows an example of the headphone device seen from the earpad side according to the first embodiment of the present invention.

FIG. 4 and FIG. 5 are plan views which show the headphone device according to this embodiment. These FIGS. 4, 5 show the headphone device in a stored state. FIG. 4 shows the shape of the surface (the surface here is the surface where the audio output surface changes to the rear). FIG. 5 shows the shape of the rear surface (audio output surface). As shown in FIGS. 4 and 5, the headphone device of this example has a shape wherein the left-side speaker unit 10 and the right-side speaker unit 20 are connected by a band 30 that is wound in a circular shape. The band 30 is comprised of a material with elasticity and has a property which allow it to be extended almost straight from a state in which it is wound in a circular shape.

As an example of the composition of the band 30, a metal wire rod that has elasticity and a signal line that transfers audio signals are passed through a soft resin tube. For the metal wire rod a shape memory alloy, for example, can be used. Further, if a material is used that can be elastically deformed and can be returned from a state in which it is extended almost straight back to its original wound shape, a metal wire other than a shape memory alloy can also be used. Even further, the member of the outside of the band 30 can be comprised of a fiber intertwined in a tube shape to be thin and long instead of the resin tube.

The other end (connecting part 42) of a signal line 140 with a plug 41 to be attached to one end thereof for connecting to the audio signal source is connected to the left side speaker unit 10. This signal line 40 is also connected to the right-side speaker unit 20 through a signal line inside the band 30.

Drivers are incorporated inside each of the speaker units 10, 20. These drivers supply sound signals (audio signals) and then output the sound signals. The incorporated drivers have a diameter of a few centimeters (for example, about 9 mm~16 mm for a small driver or about 30 mm for a comparatively large driver). The plug 41 is comprised such that when the plug 41 is connected to an audio signal source, audio signals supplied from that audio signal source are supplied to the drivers of the left and right speaker units 10, 20 through the signal line. In other words, as shown in, for example, FIGS. 6A, B and C, the driver 10*a* inside the left-side speaker unit 10 is connected to the left-channel (L) electrode of the plug 41 and the ground (G) electrode. The driver 20*a* inside the right-side speaker unit 20 is connected to the right-channel (R) electrode of the plug 41 and the ground (G) electrode.

Returning to the description of FIG. 4 and FIG. 5, sponge-like earpads 11, 21 are attached to the outside of the drivers incorporated inside each of the speaker units 10, 20. The housings of the speaker units 10, 20 are comprised of a resin or a metal. As shown in FIG. 5, the approximate center of the earpads 11, 21 of each of the speaker units 10, 20 form audio output surfaces 11*a*, 21*a* and drivers (not shown in the figure) are placed inside these. These left and right audio output surfaces 11*a*, 21*a* line up almost flat when stored.

Hereupon, when the positional relationship between each of the speaker units 10, 20 and the band 30 is described, the end 31 of the band 30 is connected to the band connecting part 12 of the left-side speaker unit 10. This band connecting part 12 is located at a position off-center from the center of the almost circular shaped left-side speaker unit 10. In like manner, the end 32 of the band 30 is connected to the band connecting part 22 of the right-side speaker unit 20. This band connecting part 22 is also located at a position off-center from the center of the almost circular shaped right-side speaker unit 20.

The shape of the band 30 wound in a circular shape is such that it is wound approximately 650° (about ¾ of a turn). As shown in FIG. 4 and FIG. 5, however, the left and right speaker units 10, 20 do not lie on top of each other. The area close to the ends 31, 32 of the band 30 that connects the left and right speaker units 10, 20 forms a curve with a comparatively small radius, the center of the band 30 forms a curve with a comparatively large radius and the winding position of one end 31 and the winding position of the other end 32 are arranged at different positions.

Figure 7:
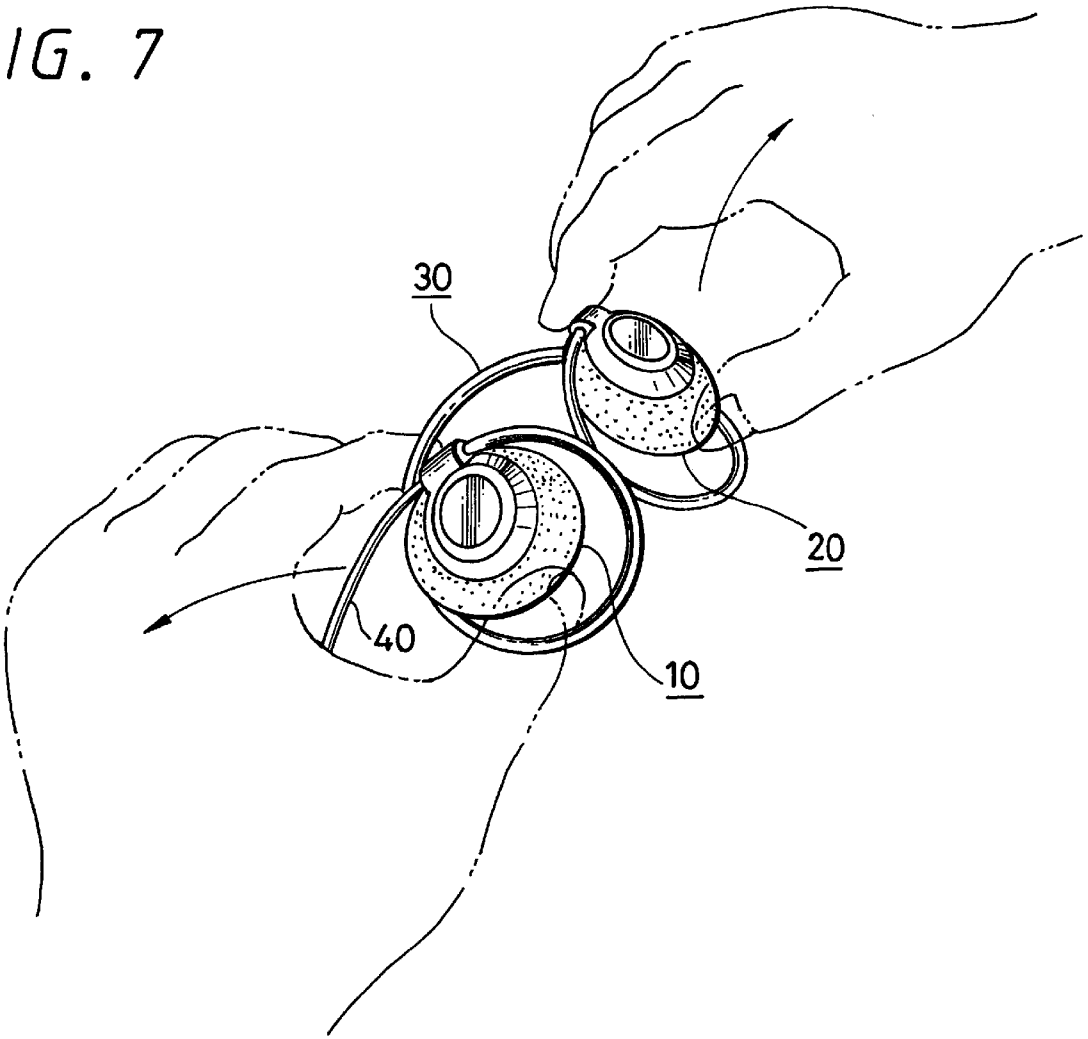
FIG. 7 is a perspective view that shows an example of how to hold the headphone device when worn according to the first embodiment of the present invention.

Next, the state when the headphone device of this example comprised in this manner is worn will be described. As shown in FIG. 7, when the listener wears the headphone device of this example, the left and right hands separately grasp the left and right speaker units 10, 20 with the surfaces (audio output surfaces 11*a*, 21*a* are opposing surfaces) of the left and right speaker units 10, 20 held upward. The left and right speaker units 10, 20 are then opened upward towards the left and right. While opening the speaker units in this manner, the band 30 is extended and, as shown in FIG. 8, the audio output surface 11*a* of the left-side speaker unit 10 and the audio output surface 21*a* of the right-side speaker unit 20 are positioned such that they are opposite each other at an interval of approximately 20 cm.

Figure 8:
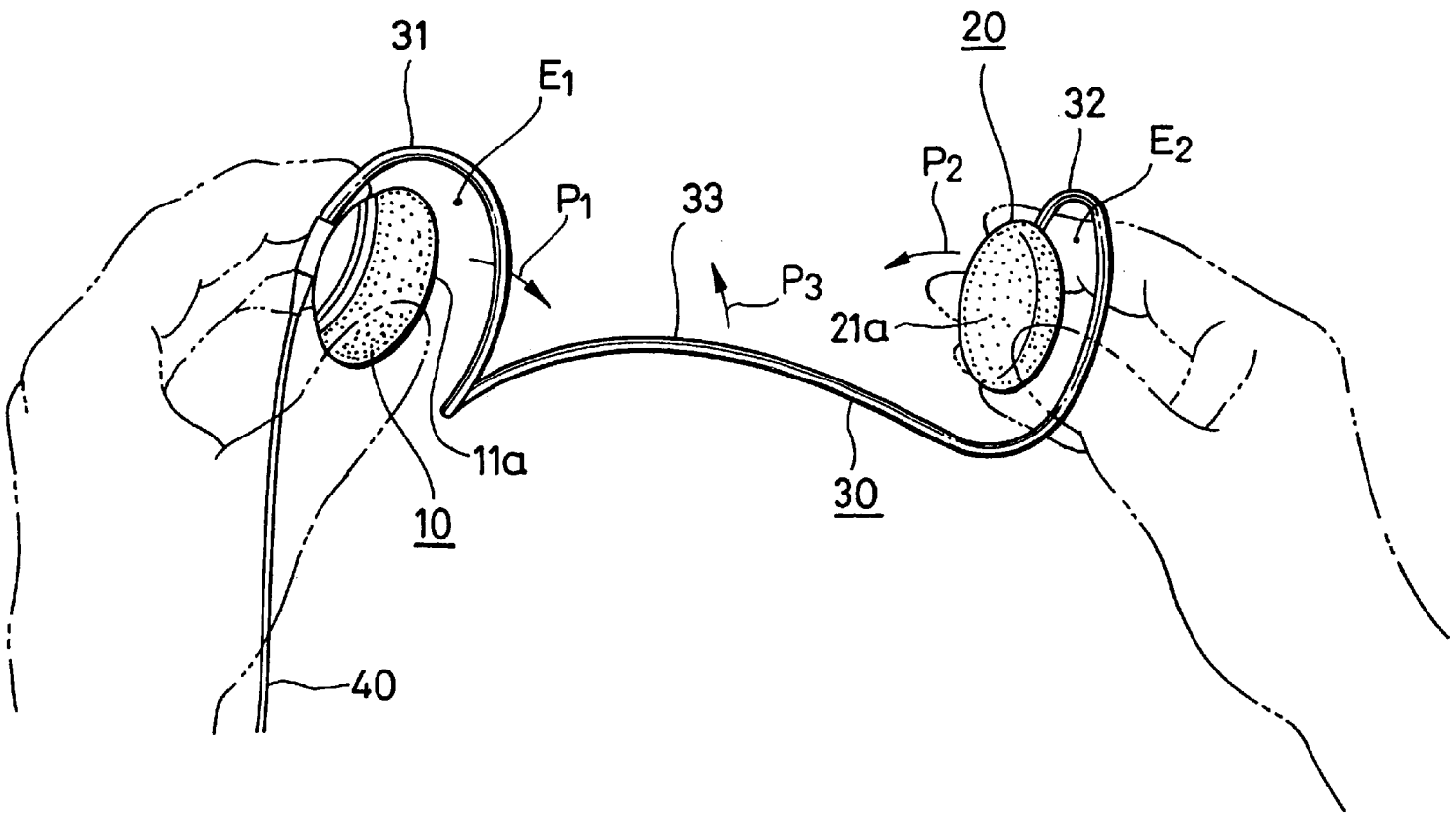
FIG. 8 is a perspective view that shows an example of the headphone device being extended in order to wear it according to the first embodiment of the present invention.

When the band is extended as shown in FIG. 8, the force that will return the band 30 to its original shape comes into play. The forces which operate at this time are indicated by arrows P1, P2 and P3 shown in FIG. 8 and can be divided up into forces P1 and P2 which mainly work to return the left and right speaker units 10, 20 towards their original direction and force P3 that works to return the middle part 33 of the band 30 from an extended state back to the original curved state.

Furthermore, when the band 30 is extended as shown in FIG. 8, a space E1 occurs between the one end 31 of the band that has a shape forming a curve with a comparatively small radius and the left-side speaker unit 10. The left ear of the wearer (listener) can just enter into this space. Further, in the same manner another space E2 occurs between the other end 32 of the band and the right-side speaker unit 20. The right ear of the wearer (listener) can just enter into this space.

Hereupon, with the band extended as shown in FIG. 8, the headphone device is brought to the rear of the head of the wearer. The upper part of the left ear of the wearer is placed in the above-mentioned space E1 and the upper part of the right ear of the wearer is placed in the space E2 and both ends 31, 32 of the band 30 are placed at the upper rear of both the right and left ears. Now, with the speaker units 10, 20 positioned on the surfaces of both the right and left ears, the headphone device is held in place on the head.

Figure 9A:
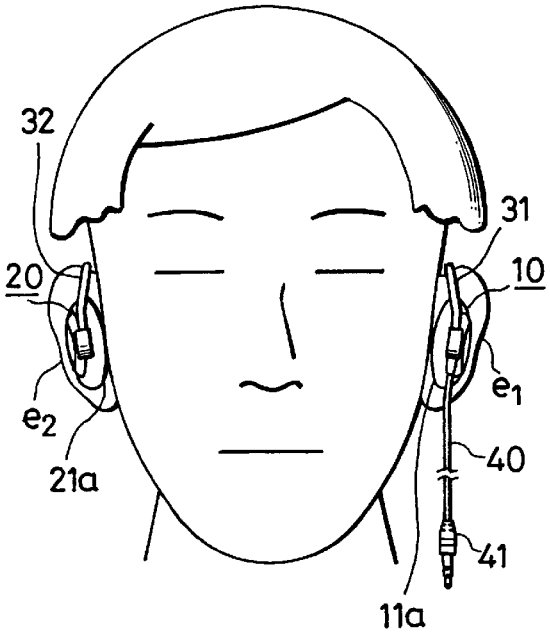
FIG. 9A is a front view.
Figure 9B:
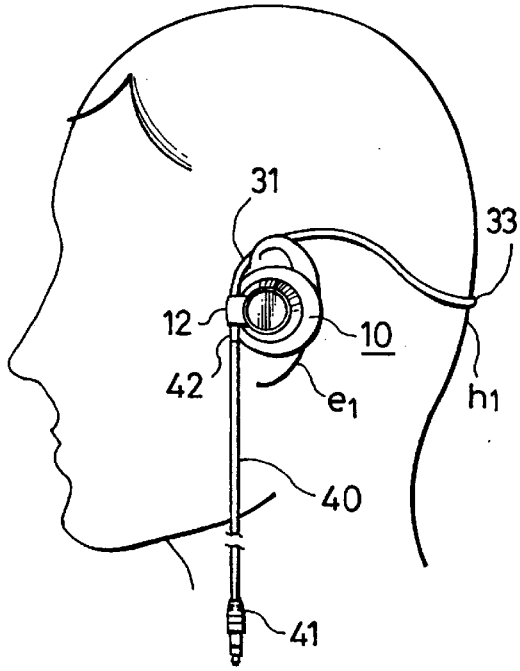
FIG. 9B is a side view and FIG. 9C is a top view.
Figure 9C:
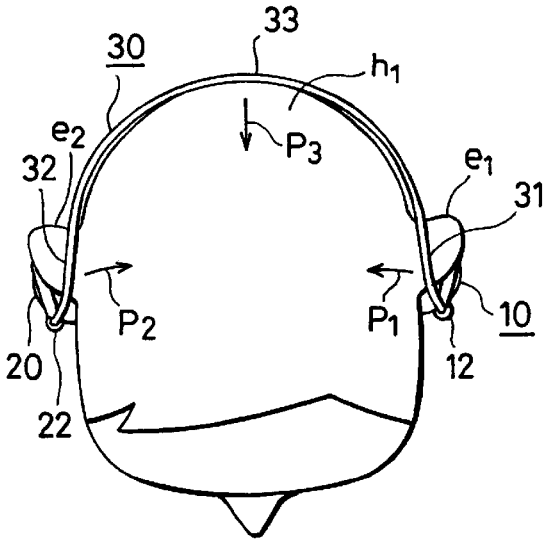

FIG. 9 shows three views when the headphone device is worn on the head of the listener in this manner. As shown in FIG. 9A, looking from the front, the left-side speaker unit 10 is positioned on the front of the left ear e1 of the listener and the right-side speaker unit 20 is positioned on the front of the right ear e2 of the listener. Further, as shown in FIG. 9B and FIG. 9C, maintaining that position is accomplished by means of the ends 31, 32 of the band 30 positioned between the upper part of the ears e1, e2 and the head.

With the headphone device worn on the head of the listener as shown in FIG. 9, the device is securely fit on the head in order that the forces (P1, P2, P3 shown in FIG. 8) come into play which will return the band 30 extended from the shape shown in FIG. 4 back to its original shape. In other words, as shown in FIG. 9C viewed from above, force P1 shown in FIG. 8 operates as a force that presses the left-side speaker unit 10 towards the center of the head and firmly fits the left-side speaker unit 10 to the ear e1. In the same manner, force P2 shown in FIG. 8 operates as a force that presses the right-side speaker unit 20 towards the center of the head and firmly fits the right-side speaker unit 20 to the ear e2. Furthermore, as shown in FIG. 9B and C, the force P3 that works on the middle part 33 of the band 30 shown in FIG. 8 functions as a force so that the rear of the head h1 and the middle part 33 come in contact with each other when worn.

Figure 10:
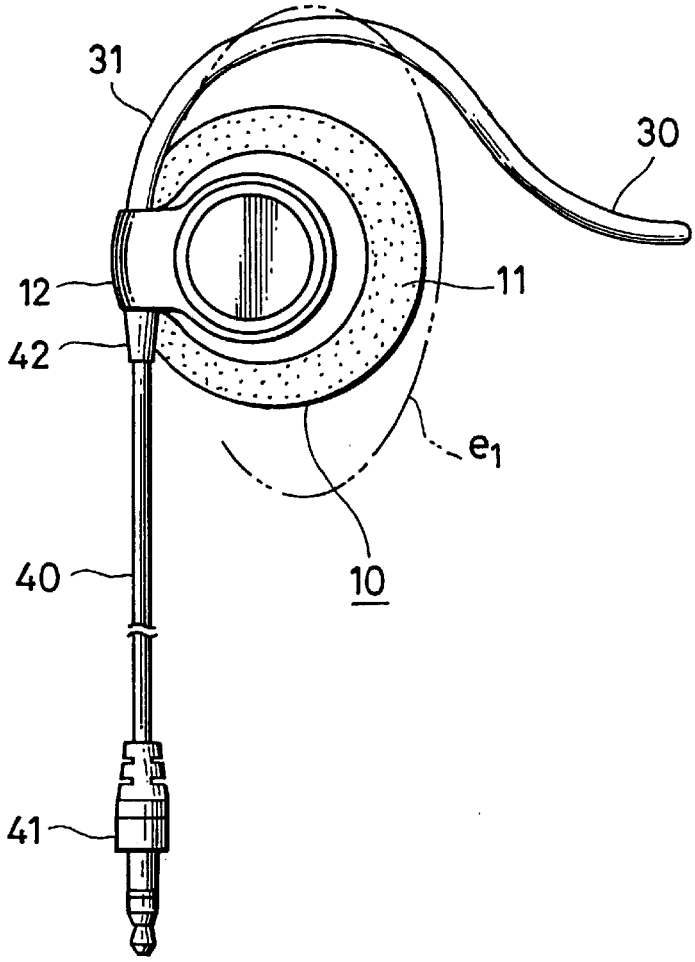
FIG. 10 is a top plan view that shows an enlarged speaker unit of the headphone device when worn according to the first embodiment of the present invention.

FIG. 10 is an expanded view showing when the headphone device is worn on the right ear e1 of the listener. Because the band connecting part 12 of the left-side speaker unit 10 deviates from the center of the left-side speaker unit 10 towards the front, the end 31 of the band 30 is positioned towards the front of the ear e1 when the left-side speaker unit 10 is attached such that it is positioned almost at the center of the ear e1. Then, it is attached in a shape such that it wraps around the rear of the head with the band 30 passing the upper rear of the ear e1 with a comparatively small diameter from the end 31 positioned at the front of the ear e1. Further, for this case, the signal line 40 that is connected to an audio signal source is extended downward from the band connecting part 12 of the left-side speaker unit 10.

In addition, by removing the headphone device being worn as shown in FIG. 9 from the head of the listener, the band 30 is returned to its original wound shape and automatically returns to a circular shape as shown in FIG. 4 and FIG. 5.

The headphone device comprised and worn in this manner is a neckband type headphone device with the band positioned at the rear of the head and feels very comfortable when worn. In other words, as shown in the wearing example of FIG. 9, the left and right speaker units 10, 20 are pressed against the left and right ears e1, e2 by the elasticity of the band 30 itself and the ends 31, 32 of the band 30 pass over the upper part of the ears e1, e2 supporting the speaker units 10, 20. This determines favorable positions for the left and right speaker units 10, 20. The force that presses against the sides of the ears when worn is determined by the force that will return the band 30 to its original shape. By means of setting the force that determines the position when worn on the ears to the minimum limit, the headphone device can be comfortably worn for long periods of time.

Further, since a force that presses against the side at the rear of the head hi is also functioning, the middle part 33 of the band 30 has almost no space occurring, unlike a conventional neckband type headphone device, between the rear of the head and the band allowing the headphone device to be comfortably worn. In particular, no space occurs at the rear of the head regardless of the shape of the head of the wearer and even if an adjustment mechanism is not provided, the headphone device fits perfectly on all wearers.

Even further, when the headphone device of this example is not being worn, the elasticity of the band 30 will automatically return the band to the small circular shape shown in FIG. 4 and FIG. 5 allowing the storage size to be reduced and eliminating any troubles when carried. For this case, since only elastic deformation of the band 30 is utilized, the necessity of a conventional mechanism that provides a hinge part that folds over is completely eliminated making it possible to realize a very simple composition and lower the cost of the headphone device.

Figures 6A, 6B, 6C:
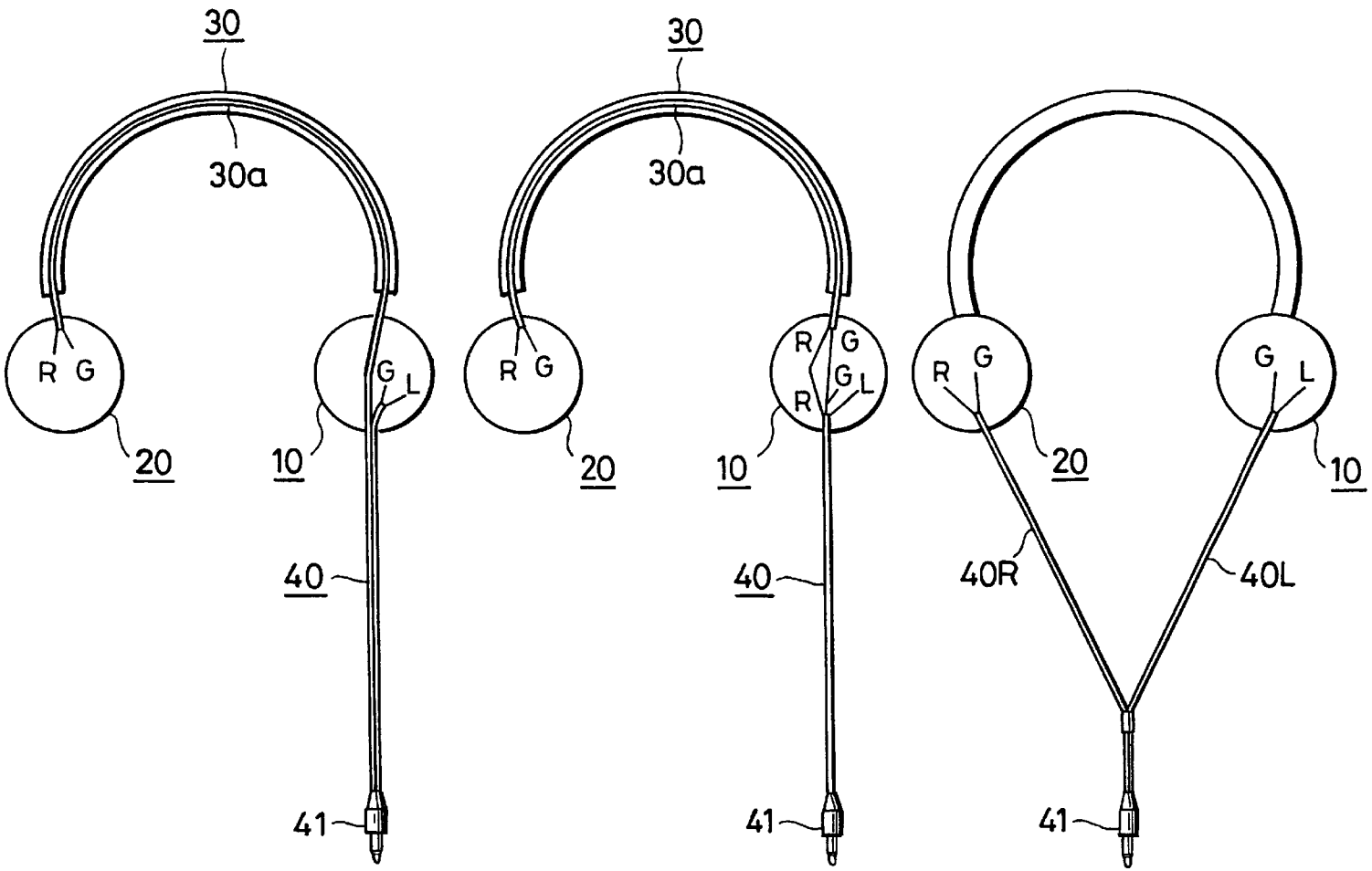
FIG. 6A is an example of a first connection circuit.
FIG. 6B is an example of a second connection circuit and FIG. 6C is an example of a third connection circuit.

In addition, each type of conventionally known format can be applied for the connection state between the signal line 40 and the left and right speaker units 10, 20. In other words, as an example as shown in FIG. 6A, four signal lines bundled together are used for the signal line 40. From among those four, two are used to connect the driver inside the headphone unit 10 to the left channel (L) electrode and the ground (G) electrode of the plug 41. The remaining two signal lines are used to connect the driver inside the headphone unit 20 to the right channel (R) electrode and ground (G) electrode of the plug 41 as a signal line 30*a* that passes inside the band 30.

Further, as an example as shown in FIG. 6B, a signal line at ground potential (G) can be used for both the left channel and right channel and three signal lines bundled together can also be used for the signal line 40. Even further, as an example as shown in FIG. 6C, a composition that can be used is shown wherein the signal line is not inserted inside the band 30. In this composition signal lines 41L and 41R are separated from the plug 41 into two lines. One signal line 41L is directly connected to the driver inside the left-side speaker unit 10 and the other signal line 41R is directly connected to the driver inside the right-side speaker unit 20.

Figure 11:
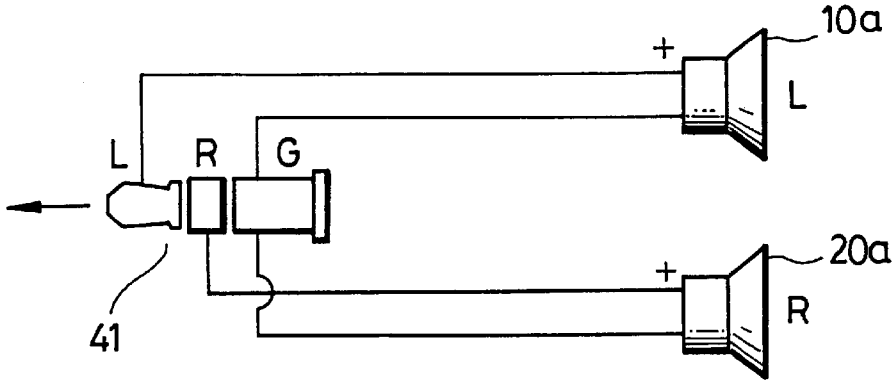
FIG. 11 is an explanatory diagram that shows a connection example of the headphone device according to the first embodiment of the present invention.

As resultantly shown in FIG. 11, in any of these connection examples, the left channel (L) electrode and the ground (G) electrode of the plug 41 are connected to the driver 10*a* inside the left-side speaker unit 10 and the right channel (R) electrode and ground (G) electrode of the plug 41 are connected to the driver 20*a* inside the right-side speaker unit 20. This supplies audio signals for the channels corresponding to the left and right speaker units 10*a*, 20*a*.

Next, a second embodiment of the present invention will be described referring to FIG. 12 to FIG. 14. The headphone device of the second embodiment is a device with a different wound shape of the band of the headphone device described in the first embodiment and has an even smaller shape when stored.

Figure 12:
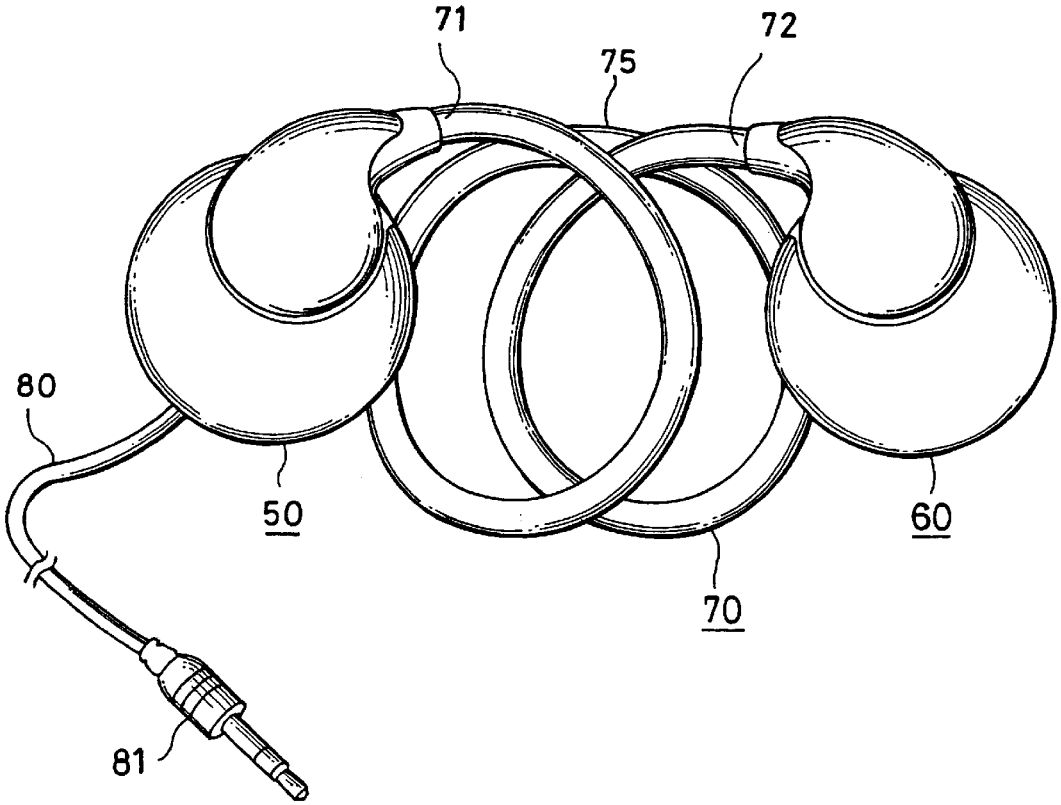
FIG. 12 is a plan view that shows an example of the headphone device seen from the surface according to a second embodiment of the present invention.

FIG. 12 is a top plan view that shows the headphone device seen according to this embodiment. FIG. 12 shows the shape of the front surface (the surface here is the surface where the audio output surface changes to the rear) of the headphone device in a stored state. The headphone device of this example consists of the band 70 that connects the left-side speaker unit 50 and the right-side speaker unit 60. The band 70 has a spiral shape that is wound about 2½ times. The winding overlap, however, changes at the middle and the middle part 75 of the band 70 is wound such that it is on the lowest side. The band 70 is comprised of a material having elastic force and has properties that allow it to be extended from being wound in a circular shape almost straight. One of the ends 71 is connected to the left-side speaker unit 50 and the other end 72 is connected to the right-side speaker unit 60.

The band 70 is comprised of a metal wire rod that has elasticity and a signal line that transmits audio signals. This wire and signal line are passed through a soft resin tube. For the metal wire rod a shape memory alloy, for example, can be used. Further, if a material is used that can be elastically deformed and can be returned from a state in which it is extended almost straight back to its original wound shape, a metal wire other than a shape memory alloy can also be used. Even further, the material of the outside of the band 70 can be comprised of a fiber intertwined in a tube shape to be thin and long instead of the resin tube.

The other end of the signal line 80 that is attached to one end of the plug 81 that connects to an audio signal source is connected to the left-side speaker unit 50. This signal line 80 is also connected to the right-side speaker unit 60 through a signal line inside the band 70.

Drivers are incorporated inside each of the speaker units 50, 60 for outputting sound when supplied with sound signals (audio signals). These internally incorporated drivers have a diameter of, for example, a few centimeters. The plug 81 is comprised such that when the plug 81 is connected to an audio signal source, audio signals (sound signals) supplied from that audio signal source are supplied to the drivers inside the left and right speaker units 50, 60 through the signal line.

Earpad (not shown in the figure) is attached to the surface on the side opposite to the surface shown in FIG. 12 of each of the speaker units 50, 60. Sounds output from the drive through these earpads are sent to the ears of the wearer.

Figure 13:
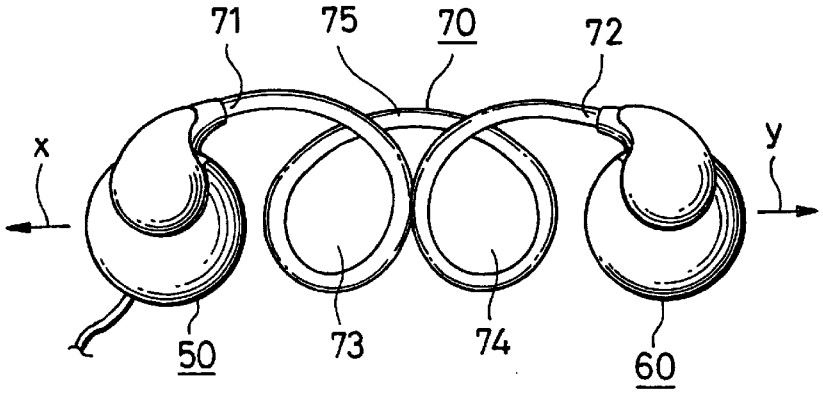
FIG. 13 is a plan view that shows an example of the headphone device extended slightly as seen from the surface according to the second embodiment of the present invention.

When the headphone device of this example is worn, at first as shown in FIG. 13, the left-side speaker unit 50 and the right-side speaker unit 60 are extended in the horizontal direction (direction of arrow x and arrow y). When the headphone device of this example is extended just a little as shown in FIG. 13, the two wound parts 73, 74 are formed in the middle of the band 70.

Figure 14:
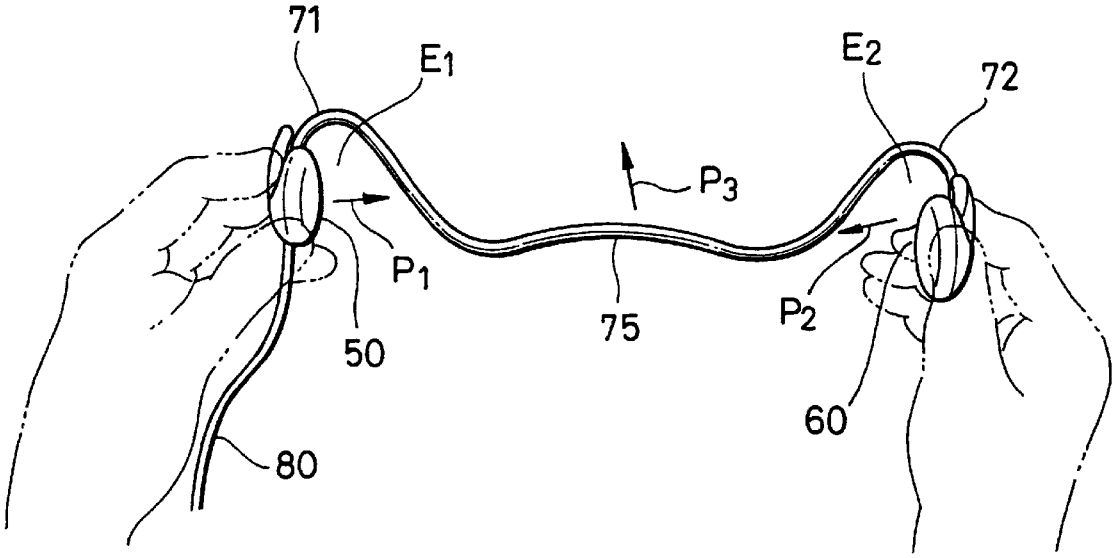
FIG. 14 is a perspective view that shows an example of the headphone device being extended in order to wear it according to the second embodiment of the present invention.

Then, as shown in FIG. 14, the audio output surface of the left-side speaker unit 50 and the audio output surface of the right-side speaker unit 60 are positioned opposite each other after the space between the left-side speaker unit 50 and the right-side speaker unit 60 are extended (for example, about 20 cm). This type of positional relationship causes the forces to occur which will return the band 70 to its original shape in like manner to the headphone device described in the first embodiment above. Force P1 of the left-side speaker unit 50 acts towards the center direction, force P2 of the right-side speaker unit 60 acts towards the center direction and force P3 pushes the middle part of the band 70 onto the side of the head of the wearer.

Because of this, the space E1 between the left-side speaker unit 50 and the end 71 of the band 70 passes over the upper part of the left ear of the wearer and the space E2 between the right-side speaker unit 70 and the end 72 of the band 70 passes over the upper part of the right ear of the wearer. This allows the headphone device to be comfortably worn in the same manner as the headphone device described in the first embodiment.

By means of using the headphone device of the second embodiment in this manner, the headphone device can be reduced in size even more when stored making it for example, easy to carry.

Next, a third embodiment of the present invention will be described referring to FIG. 15 to FIG. 17. The headphone device of the third embodiment of the present invention uses a vertical-in-the-ear type format for the headphone unit (hereinafter referred to as vertical type). For this vertical type the audio output surface inside the headphone unit is worn perpendicular to the opening of the ear.

Figure 15:
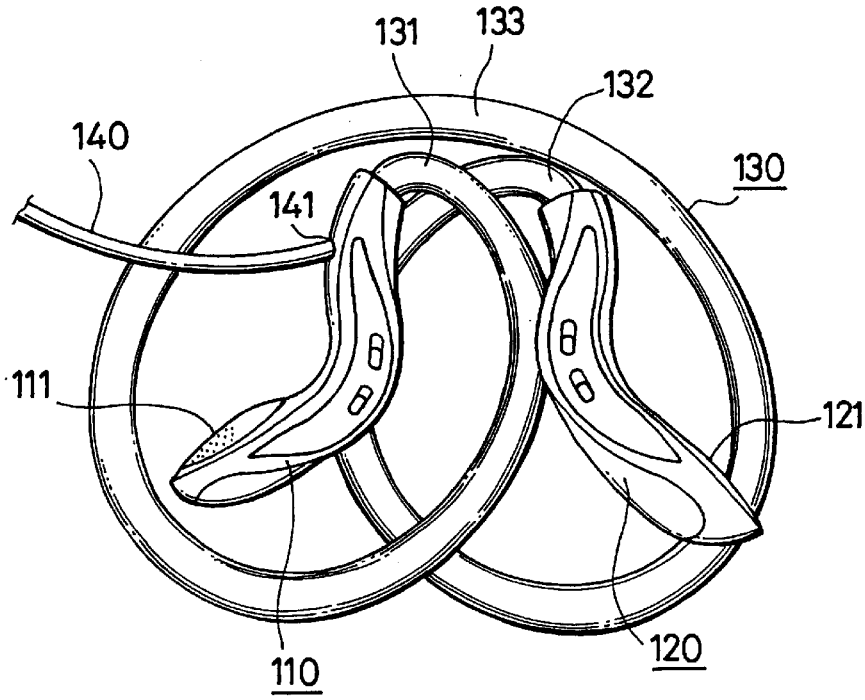
FIG. 15 is a plan view that shows an example of the headphone device seen from the surface according to the third embodiment of the present invention.

FIG. 15 is a top plan view that shows the headphone device according to the third embodiment. FIG. 15 shows the shape of the front of the headphone device when stored. The headphone device of this example uses the above-mentioned vertical type for the left-side speaker unit 110 and the right-side speaker unit 120. The drivers incorporated inside the speaker units 110, 120 have comparatively small diameters of approximately 16 mm. The use of small drivers makes it possible to have a shape that allows the end of the unit to be slightly inserted into the opening of the ear of the wearer. The housings that comprise the speaker units 110, 120 is formed of a resin.

The band 130 used in this example uses a band with a shape identical to the band 30 described in the first embodiment and is wound approximately 650° (namely, about ¾ of a turn). The band 130 is comprised of a material with elasticity and has properties which allow it to be extended from a state in which it is wound in a circular shape almost straight. One end 131 is connected to the left-side speaker unit 110 and the other end 132 is connected to the right-side speaker unit 120. The band 130 is wound with a comparatively small diameter close to the end 131 and the other end 132 and the middle part is wound with a comparatively large radius.

As an example of the composition of the band 130, a metal wire rod that has elasticity and a signal line that transfers audio signals are passed through a soft resin tube. For the metal wire rod a shape memory alloy, for example, can be used. Further, if a material is used that can be elastically deformed and can be returned from a state in which it is extended almost straight back to its original wound shape, a metal wire other than a shape memory alloy can also be used. Even further, the material of the outside of the band 70 can be comprised of a fiber intertwined in a tube shape to be thin and long instead of the resin tube.

A plug, that functions to connect the headphone device to an audio signal source, is connected to one end of the signal line 140 attached to the end of the left-side speaker unit 110. This signal line 140 is also connected to the right-side speaker unit 120 through a signal line inside the band 130.

Drivers are incorporated inside each of the speaker units 10, 120. These drivers supply sound signals (audio signals) and then output the sounds. For this case, the headphone device of this example is a vertical type and the audio output surfaces 111, 121 from the drivers are positioned almost upright as shown in FIG. 15. Further, when the plug at the end of the signal line 140 is connected to an audio signal source, the audio signals (sound signals) supplied from that audio signal source are supplied to the drivers inside the left and right speaker units 110, 120 through the signal line.

Describing the wearing state of the headphone device of this example, the left and right speaker units 110, 120 are separately held in the left and right hands when the listener wears the headphone device of this example and the band is extended while opening the device towards the left and right. Then, as shown in FIG. 16, the audio output surface 111 of the left-side speaker unit 110 and the audio output surface 121 of the right-side speaker unit 120 are positioned to be lined up parallel to each other with a space of approximately 20 cm between them.

Figure 16:
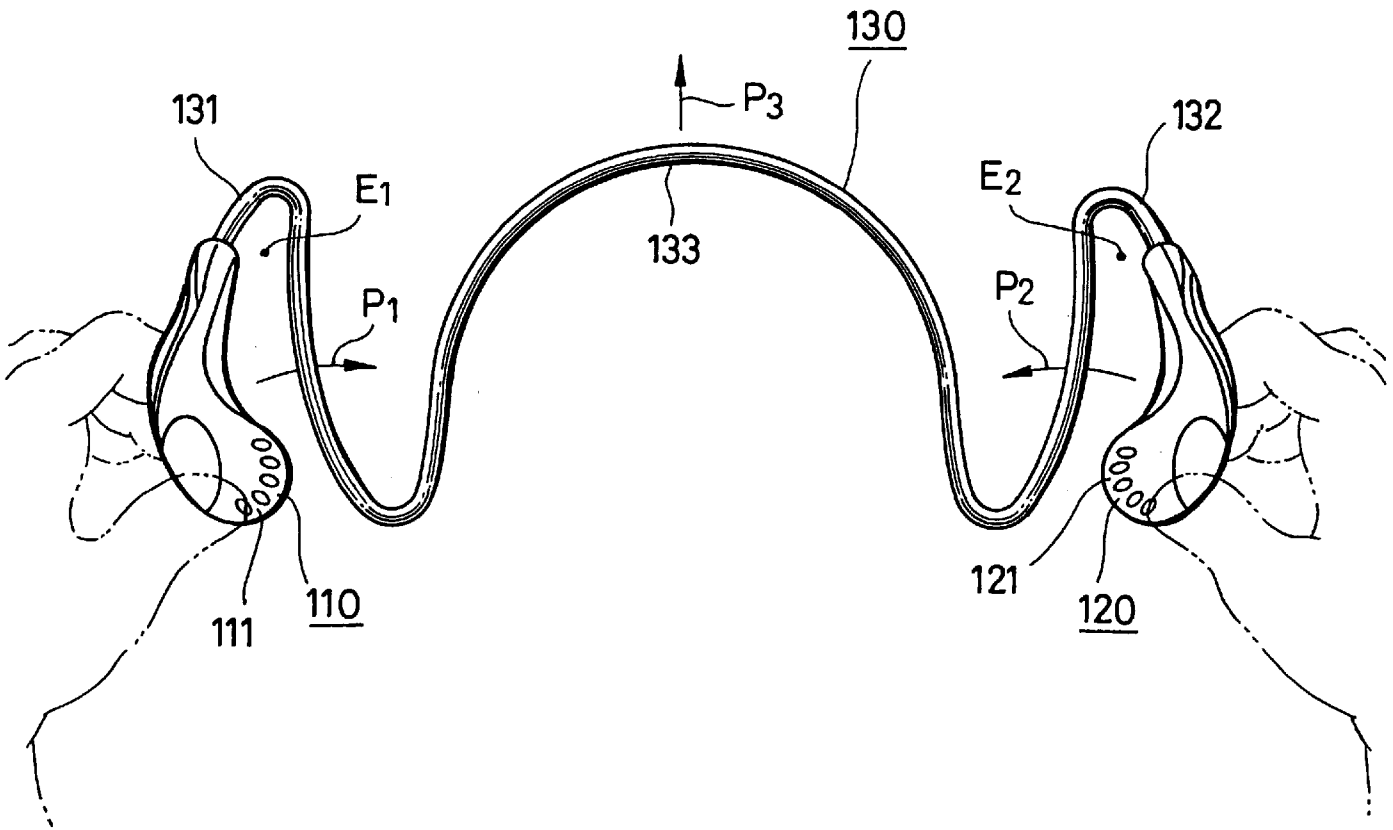
FIG. 16 is a perspective view that shows an example of the headphone device being extended in order to wear it according to a third embodiment of the present invention.

When the band 130 is extended in the state shown in FIG. 16, the force that will return the band 30 to its original shape comes into play. The forces which operate at this time are indicated by arrows P1, P2 and P3 shown in FIG. 16 and can be divided up into forces P1 and P2 which mainly work to return the left and right speaker units 110, 120 towards their original direction and force P3 that works to return the middle part 133 of the band 130 from an extended state back to the original curved state.

Further, when the band 130 is extended in the state shown in FIG. 16, a space E1 occurs between one end 131 of the band that has a shape forming a curve with a comparatively small radius and the left-side speaker unit 110. The left ear of the wearer (listener) can just enter into this space. In the same manner another space E2 occurs between the other end 132 of the band and the right-side speaker unit 120. The right ear of the wearer (listener) can just enter into this space.

Hereupon, with the band extended as shown in FIG. 16, the headphone device is brought to the rear of the head of the wearer. The upper part of the left ear of the wearer is placed in the above-mentioned space E1 and the upper part of the right ear of the wearer is placed in the space E2 and both ends 131, 132 of the band 130 are placed at the upper rear of both the right and left ears. Now, with the speaker units 110, 120 positioned on the surfaces of both the right and left ears, the headphone device is held in place on the head.

Figure 17A:
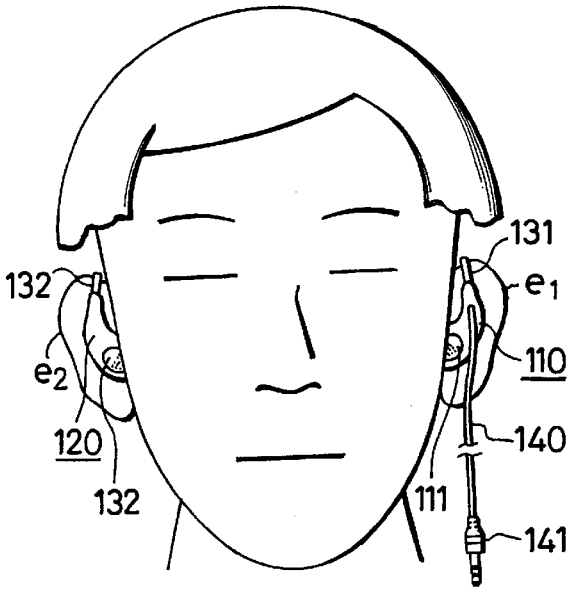
FIG. 17 is three plan views showing examples of the headphone device when worn according to the third embodiment of the present invention.
Figure 17B:
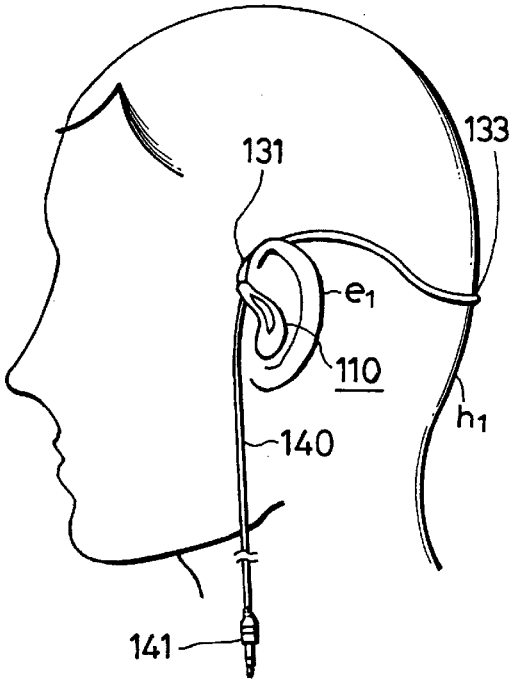
Figure 17C:
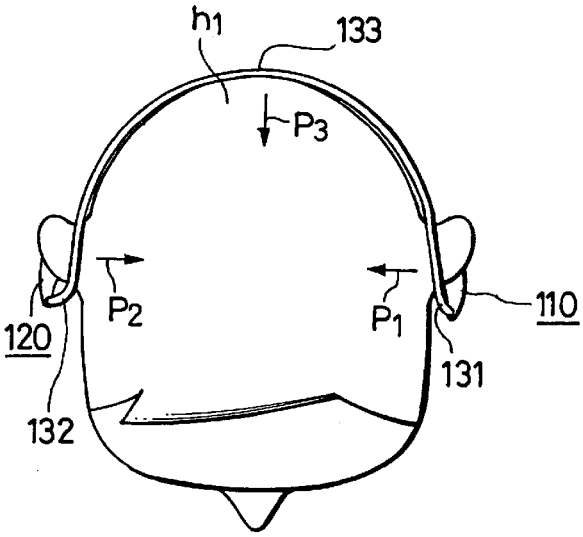

FIG. 17 shows three views when the headphone device is worn on the head of the listener in this manner. As shown in FIG. 17A, looking from the front, the left-side speaker unit 110 is positioned on the front of the left ear e1 of the listener and the right-side speaker unit 120 is positioned on the front of the right ear e2 of the listener. At this time, the audio output surfaces 111, 112 of both of the speaker units 110, 120 are facing towards the front. Further, as shown in FIG. 17B and FIG. 17C, maintaining that position is accomplished by means of the ends 131, 132 of the band 30 positioned between the upper part of the ears e1, e2 and the head. The plug 141 is also attached to the end of the signal line 140 connected to the left-side speaker unit 110.

With the headphone device worn on the head of the listener as shown in FIG. 17, the device is securely fit on the head in order that the forces (P1, P2, P3 shown in FIG. 16) come into play which will return the band 130 extended from the shape shown in FIG. 15 back to its original shape.

In other words, as shown in FIG. 17C viewed from above, force P1 shown in FIG. 16 operates as a force that presses the left-side speaker unit 110 towards the center of the head and firmly fits the left-side speaker unit 110 to the ear e1. In the same manner, force P2 shown in FIG. 16 operates as a force that presses the right-side speaker unit 120 towards the center of the head and firmly fits the right-side speaker unit 120 to the ear e2. Furthermore, as shown in FIGS. 17B and C, the force P3 that works on the middle part 133 of the band 130 shown in FIG. 16 functions as a force that pushes the rear of the head hi when worn. No space occurs between the middle part 133 of the band 130 and the rear of the head h1.

By means of wearing this headphone device in this manner, the device can be worn very comfortably just like the headphone device described in the first embodiment. Also, the force of the band automatically reduces the size (shown in FIG. 15) of the headphone device when stored making it possible to reduce the storage space which also makes it easy to carry. In addition, the vertical type speaker units described in this third embodiment can be connected to a band that is wound double in a spiral shape as described in the second embodiment which further reduces the size when stored.

Even further, in the vertical type headphone device in the third embodiment wherein the audio output surface of the speaker units face towards the front of the wearer, a similar band can be attached to a so-called inner ear type headphone device wherein the speaker units which have internally incorporated drivers with diameters of, for example, 16 mm or 9 mm are inserted into the opening of the ear and worn.

Although the first, second and third embodiments described up to now had compositions wherein the areas close to the ends of the band that connects the left and right speaker units were arranged directly at the rear of the ears of the listener and the speaker units hung on the ears, the band itself can pass under the ears and be fastened to the ears using a separate support member attached to the speaker units or the band.

Figure 18:
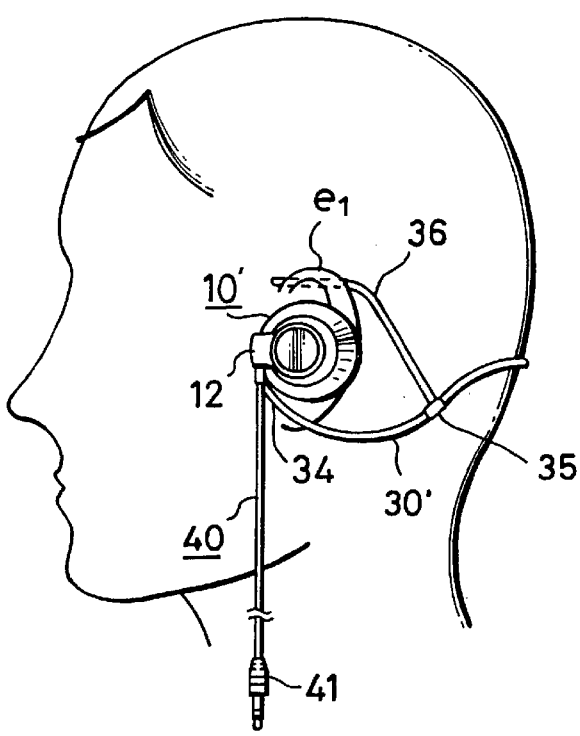
FIG. 18 is a side view that shows a modified example of the headphone device when worn according to the first embodiment of the present invention.

In other words, as shown in, for example, FIG. 18, a composition is provided in which the end 34 of the band 30' is connected to the lower side of the band connecting part 12 of the speaker unit 10' and a support member 36 comprised of a resin or the like stretches upward from the support connecting part 35 located in the middle of the band 30'. The support member 36 is hung on the upper rear of the ear e1. The headphone device is worn can be this manner.

Figure 19:
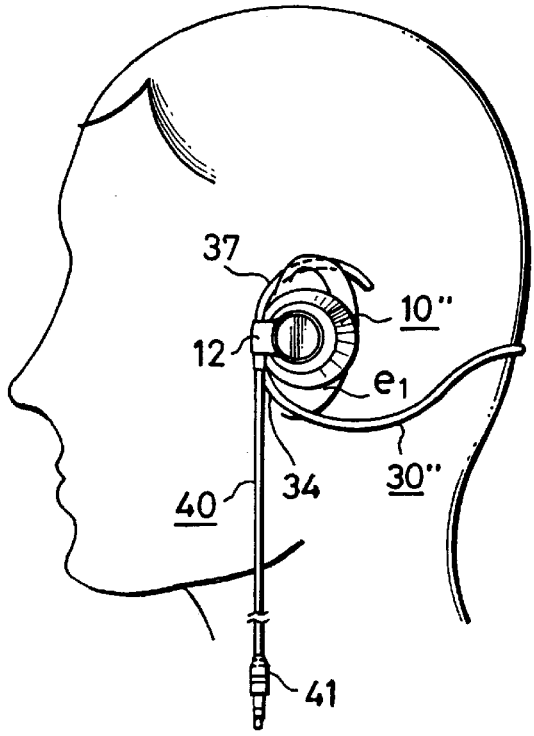
FIG. 19 is a side view that shows another modified example of the headphone device when worn according to the first embodiment of the present invention.

Further, as shown in, for example, FIG. 19, a composition is provided in which the end 34 of the band 30" is connected to the lower side of the band connecting part 12 of the speaker unit 10" and a support member 37 comprised of a resin or the like stretches upward from the upper side of the band connecting part 12. The support member 37 is hung on the upper rear of the ear e1. The headphone device can be worn in this manner.

For the vertical type headphone device described in the third embodiment, even if the device has a shape wherein the band passes under the ear, the speaker units fit into the opening of the ears. Consequently, the headphone device can have a shape that is not provided with any particular support member.

The headphone devices and band shapes described in each of the above embodiments are only examples and other shapes can be used. Even further, the headphone device can also have a microphone attached to the middle, or another location, of a signal line that connects one end of the headphone unit and the plug and be used for portable telephone terminals (as a headset).

INDUSTRIAL APPLICABILITY

According to the headphone device related to the present invention described above, the elasticity of the band itself when stored will wind the band into a circular shape thereby reducing the size giving it a convenient shape for storage and transport. In addition, when worn, because the area close to the ends of the extended band forms a curve and passes above or below the ears of the listener, the speaker units are held on the ears with the approximate center of the band pressing down on the rear of the head of the listener. Consequently, the band itself is worn on the head of the listener with almost no space eliminating the need for a separate adjustment mechanism providing a comfortable wearing experience for everyone. For this case, because the elasticity of the band itself determines the shape when stored and when worn, the composition is very simple. Namely, this makes it possible to achieve a simple construction with favorable portability and wearability as a so-called neckband type headphone device.

What is claimed is:

1. A headphone device comprising:

a left-side speaker unit worn on a left ear of a listener;

a right-side speaker unit worn on a right ear of the listener; and a band formed from an elastic material having shape memory properties, wherein said left-side speaker unit is connected to one end of said band and said right-side speaker unit is connected to an other end of said band;

said band has a shape such that a portion of said band proximate to a connecting part of each of said left-side speaker unit and said right-side speaker unit forms a curve and passes on one of a position above and below the respective ears of the listener when said band is extended;

said band has a shape such that said band presses at an approximate center on a rear of the head of the listener; and said shape memory properties of said band causes said band to wind into a circular shape when said device is not worn by said listener, and wherein separate support members to be hung on the ears of the listener are attached close to the connecting parts between each of said speaker units and said band.

2. The headphone device according to claim 1, wherein an audio signal line that connects one of the left-side and right-side speaker units to the other speaker unit is passed through said band and connects to an audio signal source from only one of the left-side and right-side speaker units.

3. The headphone device according to claim 1, wherein said left-side speaker unit and said right-side speaker unit are positioned in close proximity to each other due to said shape memory properties of said band when said headphone device is not being worn by the listener.

4. The headphone device according to claim 3, wherein when said left-side speaker unit and said right-side speaker unit are positioned in close proximity to each other due to said shape memory properties of said band when said headphone device is not being worn by the listener, audio output surfaces of said left-side and right-side speaker units are approximately aligned.

5. The headphone device according to claim 1, wherein portions of each of said connecting parts close to the band are formed in a curved shape that rests above the respective ears of the listener when said band is extended.

* * * * *